US006871517B2

(12) United States Patent
Bonelli et al.

(10) Patent No.: US 6,871,517 B2
(45) Date of Patent: Mar. 29, 2005

(54) BUCKLE

(75) Inventors: Jonathan J. Bonelli, New York, NY (US); Matt Cowdell, Holtsville, NY (US); Mitchell Saccoccio, Lake Ronkonkoma, NY (US); Gennady I. Kleyman, Brooklyn, NY (US)

(73) Assignee: Stealth Industries Ltd., Hong Kong (CN)

( * ) Notice: Subject to any disclaimer, the term of this patent is extended or adjusted under 35 U.S.C. 154(b) by 0 days.

(21) Appl. No.: 10/320,988

(22) Filed: Dec. 17, 2002

(65) Prior Publication Data

US 2004/0112098 A1 Jun. 17, 2004

(51) Int. Cl.[7] ..... E05B 69/00; E05B 73/00
(52) U.S. Cl. ..... 70/58; 24/166
(58) Field of Search ..... 70/58, 14–18; 24/166, 167, 614, 615, 665, 671, 672

(56) References Cited

U.S. PATENT DOCUMENTS

| | | | | | |
|---|---|---|---|---|---|
| 1,083,612 | A | * | 1/1914 | Hooker | 70/18 |
| 3,008,319 | A | | 11/1961 | Cheney | 8/3 |
| 4,150,464 | A | | 4/1979 | Tracy | 24/77 R |
| 4,398,324 | A | | 8/1983 | Bakker et al. | 24/230 R |
| 4,500,120 | A | | 2/1985 | Ridgewell et al. | 24/230 R |
| 4,912,950 | A | * | 4/1990 | Crowle | 70/58 |
| 4,930,324 | A | * | 6/1990 | Meier | 70/18 |
| 5,117,663 | A | * | 6/1992 | Ida | 70/64 |
| 5,193,368 | A | * | 3/1993 | Ling | 70/30 |
| 5,311,649 | A | * | 5/1994 | Suh | 24/625 |
| 5,517,836 | A | * | 5/1996 | Hong | 70/30 |
| 5,548,879 | A | * | 8/1996 | Wu | 24/625 |
| 5,613,381 | A | * | 3/1997 | Savage | 70/16 |
| 5,687,593 | A | * | 11/1997 | Cross | 70/16 |
| 5,743,117 | A | * | 4/1998 | Woo et al. | 70/16 |
| 5,774,956 | A | * | 7/1998 | French et al. | 24/625 |
| 5,794,461 | A | * | 8/1998 | Smith | 70/16 |
| 5,797,284 | A | * | 8/1998 | Lurie | 70/16 |
| 5,842,359 | A | * | 12/1998 | Longueira | 70/14 |
| 6,418,760 | B1 | * | 7/2002 | Fettes | 70/71 |

* cited by examiner

*Primary Examiner*—John B. Walsh
(74) *Attorney, Agent, or Firm*—Dilworth & Barrese, LLP.

(57) ABSTRACT

A buckle is operative to have a locking state wherein engaging components are prevented from displacement relative one another simultaneously with their engagement.

11 Claims, 6 Drawing Sheets

BUCKLE

BACKGROUND

1. Technical Field

The invention relates to a buckle and more particularly to a lockable buckle for securing separate ends, portions or parts of any item configured to have releasing and locking states.

2. Background of Related Art

Buckles generally are used on belts, accessories, garment and container covers to secure various belt ends. Traditionally, buckle assemblies have encompassed two basic members, a clasp or latch and a clasp fastener matable to secure the belt, cover or other element. Many of these buckles utilize a release mechanism to disengage the mating latch and fastener.

Illustrative of a releasing buckle assembly is the structure shown in U.S. Pat. No. 4,150,464, which has a buckle with locking tabs matable in a receptacle. The tabs are engageable with sidewall slots to secure the buckle, and subsequent depression of these tabs in the slots permits withdrawal of the buckle and disengagement of the connected members.

Many buckle assemblies have locking means to fix the clasp and fastener against inadvertent or unwanted disengagement. Indicative of such a locking buckle assembly is the structure shown in U.S. Pat. No. 3,008,319, which uses a keeper in the casing rotatable by a key to maintain the securing tabs in their slots. Counter rotation of the key and keeper permits disengagement of the clasp and fastener. This buckle is composed of a plurality of discrete components, which leads to a complex structure. However, almost all of these securing devices operate to maintain the above-noted tabs sidewardly projecting to contact hooks or slots. A lock having a central cam with a groove-tracking pintle is operable with side projecting fingers for securing coupled members, as noted in U.S. Pat. No. 4,500,120.

Center-release buckles are used as an alternative coupling arrangement for buckle fasteners and are exemplified by the structures shown in U.S. Pat. No. 4,398,324. In the former, a clasp tongue is insertable in a fastener receptacle and a raised tongue portion is urged to mate with an aperture in the receptacle top wall to secure the buckle assembly. The releasable buckle in the latter includes a tongue that extends essentially to the rearmost portion of the receptacle casing before coming into register with a locking edge.

While all of the above-discussed buckle assemblies successfully operate to meet their respective objectives, in accordance with the fundamental principle of operation, the latch and fastener are immediately engaged, not locked upon insertion. To lock the buckle and, therefore, to prevent inadvertent disengagement of its components, the user should rotate a lock in a locking position after the components of the buckle have been engaged.

In many instances, however, it is advantageous to reverse the principle of operation and lock the latch in the fastener simultaneously with their engagement. Furthermore, aesthetically, economically and functionally, it is desirable to provide a buckle with a locking apparatus to prevent inadvertent or unwanted release of a coupled buckle fastener in accordance with the principle discussed above and to produce the buckle with a simple structure.

SUMMARY OF THE INVENTION

A buckle assembly assuming a locked state in which a latch and a fastener are automatically prevented from relative motion simultaneously with their engagement attains these objectives. Structurally, the inventive buckle assembly includes a fastener housing a locking assembly, which is configured to prevent the tabs of the ledge from disengagement once the ledge slides into the engagement with the fastener.

The criticality of the inventive locking assembly lies in a locking element configured to abut the tabs of the inserted latch from inside in a locked position of the locking assembly. In this position, even if an external force is applied to the tabs, their inward displacement, which, otherwise, would allow the latch to be withdrawn from the fastener, is blocked.

To disengage the coupled components, the locking element is rotated and because of its flexibility, the locking element can be enabled to move out of the locked position towards a releasing position to clear a space, which allows inward displacement of the tabs and subsequent release of the latch.

In accordance with one aspect of the invention, the locking assembly includes a key-actuated rotatable cam surface, which in a normal position biases the locking element to its locked position. The cam element, mounted in the fastener, is so dimensioned and shaped that the tabs of the latch can slide past it before engaging the fastener. However, once engaged, the tabs are automatically prevented from any further displacement ensuring, thus, lockable engagement of the latch and the fastener.

In accordance with another embodiment, a key is configured to come into contact with the flexible element upon insertion of the key in a keyhole. Displacement of the key causes the flexible element to move from a locking position, wherein the tabs of the latch pressed upon, to a releasing position, in which the tabs of the latch can move inwards and release the latch.

Still another aspect of the invention relates to a knob mounted displaceably on the fastener and movable perpendicular to a direction of displacement of the flexible element so as to enable the flexible element to move from the locking position to the releasing position.

OBJECTS OF THE INVENTION

It is therefore a principle object of the invention to provide a buckle having a latch and a fastener locked simultaneously with their engagement.

A further object of the invention is to provide various user-friendly modifications of a locking assembly.

Yet another object of the invention is to provide the buckle having a simple structure including a few separate components easily manufactured and assembled to provide a cost efficient buckle.

BRIEF DESCRIPTION OF THE DRAWINGS

The above and other objects, features and advantages will become more readily apparent from the detailed description of the preferred embodiment accompanied with the following drawings, in which.

SPECIFIC DESCRIPTION

In accordance with the inventive concept a buckle assembly 10, as shown in FIGS. 1–14, operates so that as a latch 14 slides into engagement with a fastener 12, these components are locked. To unlock the buckle 10, it is necessary to introduce an external element, such as a key or a button, operation of which is controlled by the user. In a released state, the latch 14 and the fastener 12 are operative to slide relative to one another and subsequently to disengage.

Figure 1:
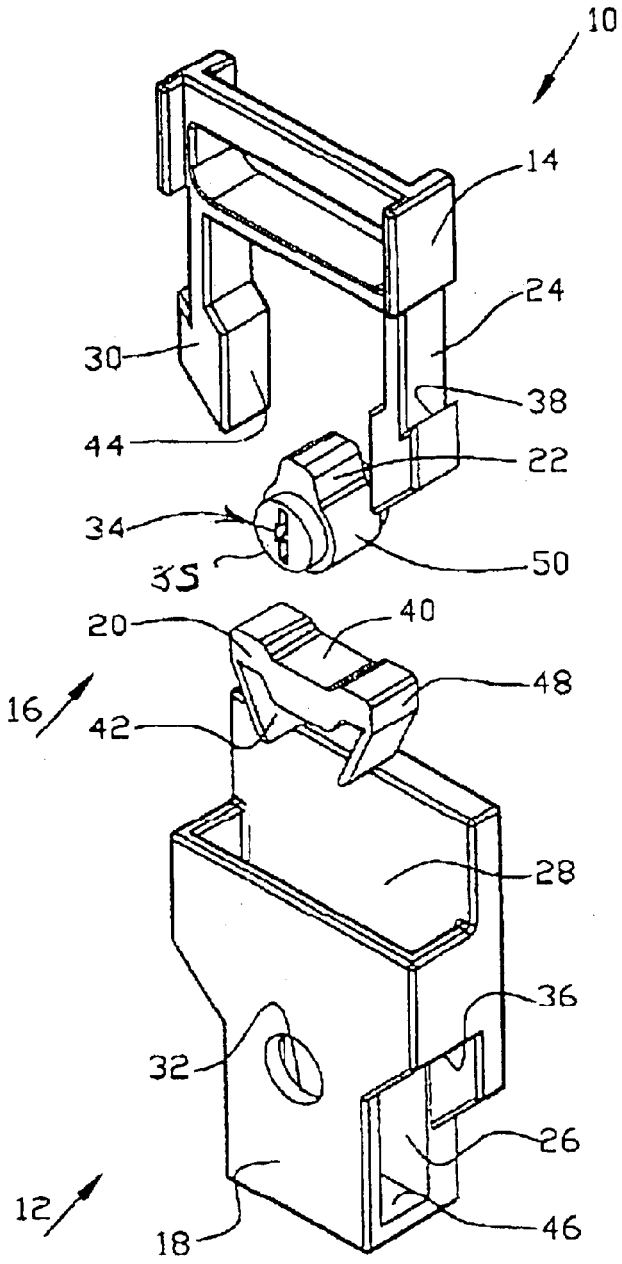
FIG. 1 is an exploded isometric view of the buckle.
Figure 2:
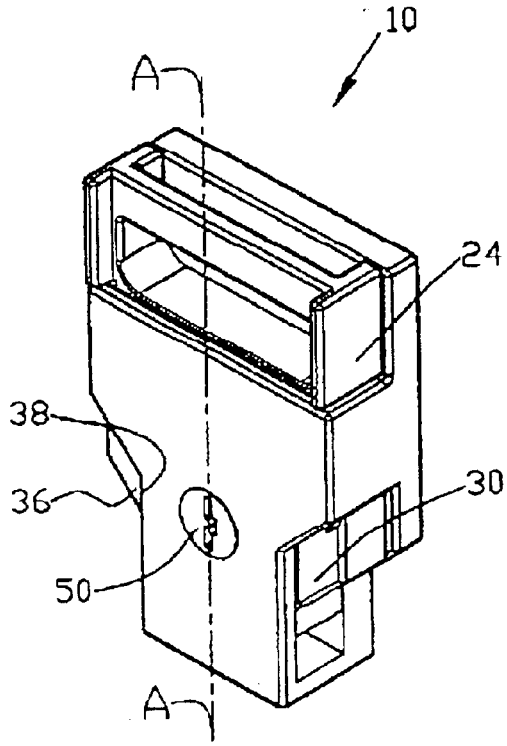
FIG. 2 is an isometric view of the buckle of FIG. 1 illustrating the initial engagement between the latch and the fastener.
Figure 3:
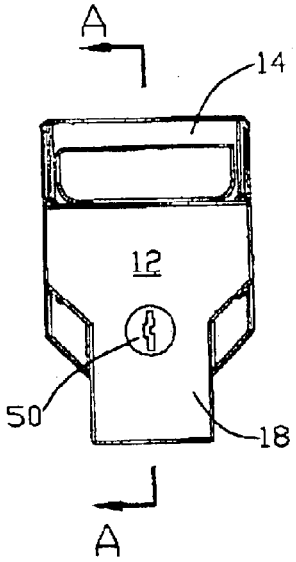
FIG. 3 a front view of the buckle illustrated in FIGS. 1 and 2 and shown in a locking position.
Figure 4:
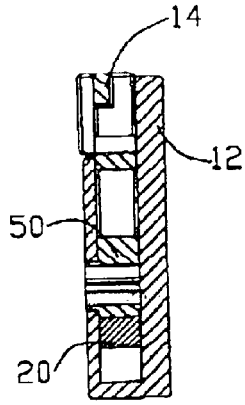
FIG. 4 is a cross-sectional view taken along lines III—III of FIG. 3.
Figure 5:
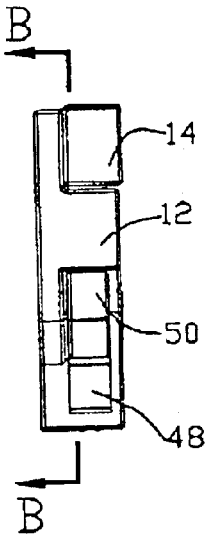
FIG. 5 is a side view of the buckle shown in FIGS. 1–3.

Referring to FIGS. 1–7, illustrating one aspect of the invention, the fastener 12 has a housing 18 provided with a pair of recesses 26 which receive tabs 30 of the latch 14 introduced into the housing through an entrance opening 28. As known in the art, the tabs 30, defining distal ends of flexible arms 24, are spaced at a distance slightly greater than the width of the entrance opening 28. To interengage the latch 14 and fastener 12, the arms 24 are made flexible to yield to an external force pushing these arms inwardly. As a consequence, once the trailing surfaces 38 of the tabs 30 reach the openings 26, as the latch 14 and the fastener slide relative to one another, the tabs 30 spring outwards. As shown in FIGS. 3–5, as a result of such tab displacement, trailing surfaces 38 of the tabs 30 and supporting surfaces 36 of the fastener 12 interengage defining, thus, an engaging state of the buckle 10, in which reverse displacement of the latch is prevented. The geometry of the trailing 38 and supporting surfaces 36 is such that the trailing and supporting surfaces on each side of the buckle extend complementary to one another in the engaging state of the buckle 10. Furthermore, while differently-shaped surfaces are envisioned within the scope of this intention, it is preferred to have these surfaces inclined with respect to a longitudinal axis A—A (FIG. 2) of the buckle.

Figure 6:
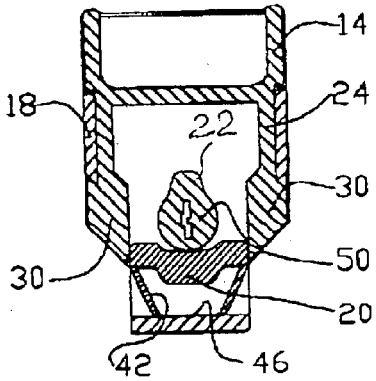
FIG. 6 is a cross-sectional view of the buckle taken along lines VI—VI of FIG. 5 and illustrating the locking state of the buckle.

In accordance with the requirements established by many industries, in addition to the engagement state, the buckle 10 has to operate in a locking state, wherein the arms 24 do not yield to an external force, which, otherwise, can lead to accidental disengagement of the latch. A locking assembly 16, configured to provide the buckle 10 with the locking state, as illustrated in FIG. 6, includes a locking element 20 and a rotatable cam 34. The locking assembly 16 is so mounted in the housing 18 of the fastener 12 that the latch 14 is automatically locked in the engagement position of the buckle.

To obtain the locking position, the locking element 20 is displaced in the distal part of the housing 18 in such a manner that flexible spring leafs 42 urge against a stop surface 46 of the housing, whereas a rear surface 40 is in contact with the cam 34. Anchoring of the locking assembly in the housing 18 is provided by a key-hole support 35 extending through a key hole 32 of the housing 18. Dimensions of the hole 32 allow the cam 34 to rotate between locked and release positions corresponding to the locking and releasing states, respectively, of the buckle. An insertable key, not shown in FIGS. 1–7, is used as an actuator for rotating the cam 34 between the locking and unlocking states of the buckle.

The locked position of the locking assembly 16 is achieved when outer sides 48 of the locking element 20 are juxtaposed with inner surfaces 44 of the tabs 30 of the latch 14 to prevent displacement of the tabs inwards. Due to the resiliency of spring leaf 42 of the locking element 20, during displacement of the latch 14 to the engagement position, the front ends of the tabs 30 push the locking element so that the spring leaves 42 slightly flex and, thus, clear a distance sufficient for the trailing surfaces 38 of the tabs to reach the recess 26. Since the resilient arms 24 of the latch are biased outwards, once the rear surfaces of the tabs reach the recess 26, the arms 24 along with the tabs 30 spread outwards to establish engagement between the trailing surfaces 38 and support surfaces 36 of the housing 18. As a consequence of the outer lateral displacement of the tabs 30, a pressure upon the locking element 20 seizes allowing it to slip rearwards so that the sides 48 overlap the inner surfaces 44 of the tabs and, thus, lock the buckle. The tabs 30 are sized to have outer sides extending flush with the sides of the housing 18 of the fastener 12.

Figure 7:
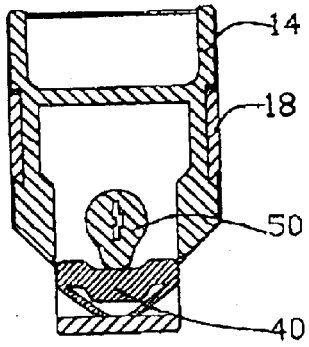
FIG. 7 is a cross-sectional view of the buckle taken along lines VI—VI of FIG. 5 and illustrating the releasing state of the buckle.
Figure 8:
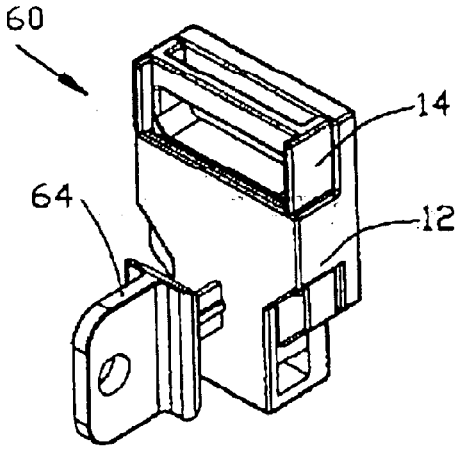
FIG. 8 is an isometric view of another embodiment of the buckle in accordance with the present invention.
Figure 9:
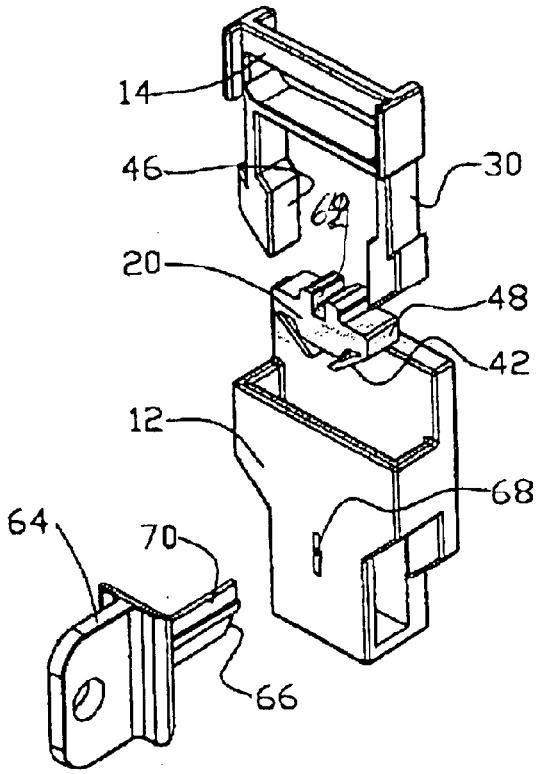
FIG. 9 is the exploded isometric view of the buckle of FIG. 8.
Figure 10:
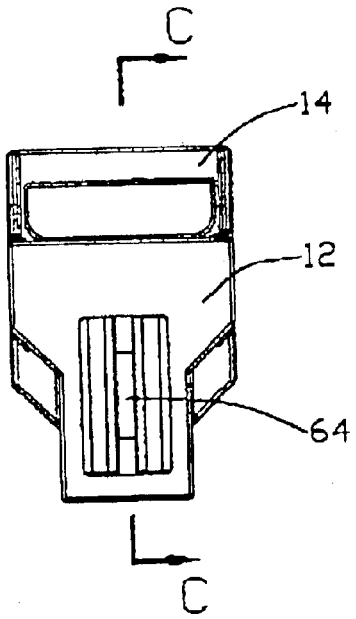
FIG. 10 is a front view of the buckle shown in FIG. 8.

A segment 50 of the outer periphery of the cam 34 arrests rearward axial displacement of the locking element upon its contact with the surface 40 of the locking element. Rotation of the cam 34 at a 180° displaces another segment 22 of the outer periphery of the cam in contact with the surface 40 of the locking element, and, because the segment 22 is axially longer than the segment 50, it pushes the locking element toward the stop surface 46 of the housing 18. Once the outer sides 48 slide past the surfaces 44 of the tabs 30, the latter can be displaced inwards in response to an external force and allow the latch to slide backwards and disengage the fastener, as seen in FIG. 7.

While the locking element 20 as shown in FIGS. 1–7, is a one-piece molded element, it is possible to configure this component as an assembly consisting of separate parts. The entire buckle is made from a corrosion resistant material, and it is preferred that this material would be composite, however, other materials including, for example, stainless steel can be readily implemented as well.

Turning to FIGS. 8–14, another aspect of the invention illustrates a simplified structure of a buckle 60 operating on the same principal as the above-disclosed structure. While the locking element 20 remains practically unmodified, as compared to the previous embodiment, the buckle 60 does not have the cam element, as previously disclosed. Instead, a key 64 is provided with a cam surface 66 cooperating with a surface 62 of the locking element 20 so as to bring the latter to the release position.

Figure 13:
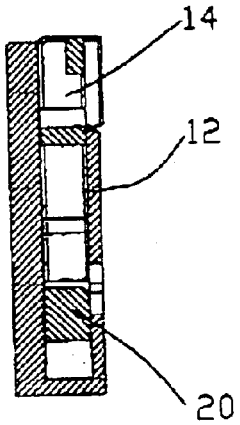
FIG. 13 is cross-sectional view similar to the view shown in FIG. 11 but illustrating the locking state of the buckle.
Figure 14:
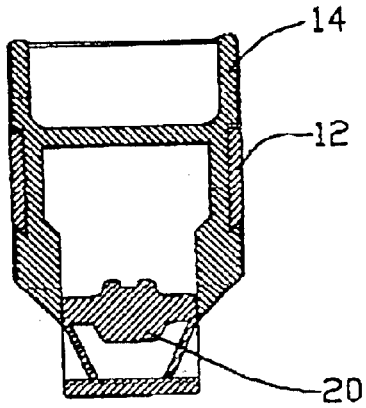
FIG. 14 is a cross-section view similar to the view illustrated in FIG. 12 but representing the locking state of the buckle.
Figure 15:
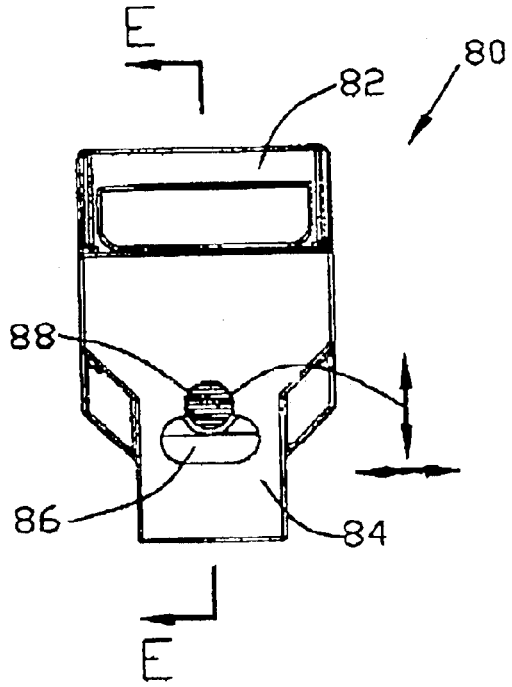
FIG. 15 is an elevated front view of the inventive buckle in accordance with yet another embodiment.
Figure 16:
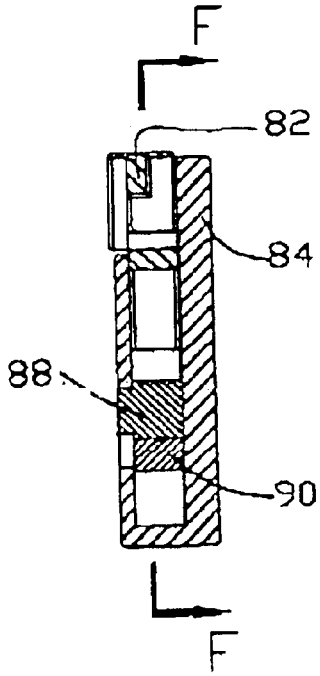
FIG. 16 is a cross-sectional view of the buckle as seen along lines XVI—XVI illustrated in FIG. 15.

The locking state of the buckle 60, as shown in FIGS. 13, 14 is defined upon engagement of outer sides of the locking element 20 with inner surfaces 46 of the tabs 30, as shown in FIG. 6. Similarly to the first embodiment, the front ends of the tabs 30 urge against outer surfaces 48 of the locking element 20 upon insertion of the latch 12 and define a locking state of the buckle 60.

Figure 11:
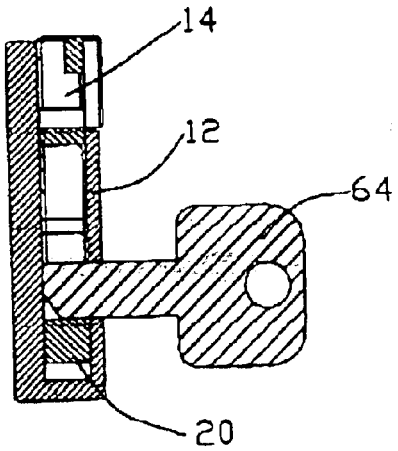
FIG. 11 is a cross-sectional view of the buckle of FIG. 8 as seen in section along lines XI—XI of the same figure and illustrating the buckle in its releasing state.
Figure 12:
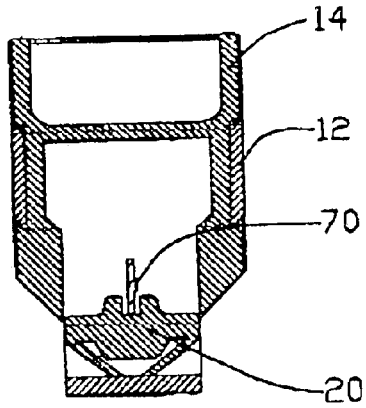
FIG. 12 is a cross sectional of the buckle of FIG. 8 as seen along lines XII—XII.

To unlock the buckle, as illustrated in FIGS. 11, 12, a stem 70 of a key 64 is inserted into a key hole 68 and, as a result of a cam slanted surface 66 formed at a distal end of the stem 70, the key 64 pushes the locking element 20 towards the front end of the fastener 14. The surface 66 is so dimensioned and shaped that frontward displacement terminates once the outer sides 48 of the locking element 20 clear the inner surfaces 46 of the tabs 30. This, in turn, provides a room inside the fastener 12, which is sufficient to accommodate inward lateral displacement of the tabs 30 in response to an external force and to allow subsequent disengagement of the latch 14. A key surface 72 configured as a groove receiving the stem 70 serves as a guide channel. Alternatively, the guide channel can be formed on the stem 70 of the key 64, whereas a cam surface can be formed on the locking element 20. Other modifications of these surfaces, which are directed to displacement of the locking element in response to insertion of the key 64, are, of course, envisioned within the scope of this invention.

Referring to FIGS. 15–20, a buckle 80, configured in accordance with the underlying principle of this invention, includes a latch 82 sliding into engagement with a fastener 84 and interlocking therewith immediately upon engagement similarly to the embodiment shown in FIGS. 1–7. The principle difference distinguishing the buckle as shown in FIGS. 15–20 from the buckle 10 shown in FIGS. 1–7 includes the provision of a knob 88, which is guided within a recess 86 formed in the fastener 84. The top and bottom of the knob 86 are dimensioned to be slightly larger than the width of the recess 86, but configured to allow the knob 86 to slide within the boundary defined by the peripheral edge of the recess in response to an external force.

Figure 17:
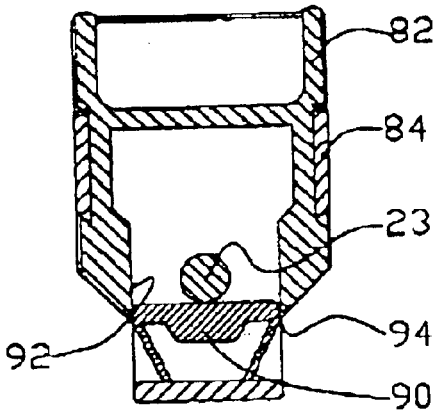
FIG. 17 is a cross-sectional view of the buckle of FIG. 16 taken along lines XVII—XVII of the same figure and illustrating the locking state of the buckle.
Figure 18:
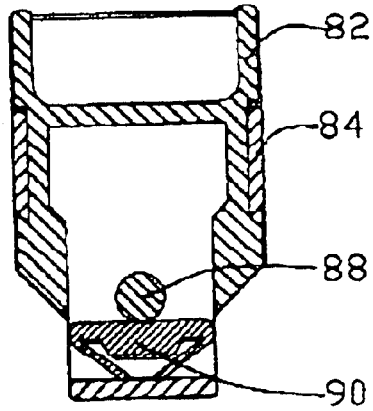
FIG. 18 is a cross-sectional view of the buckle similar to the view illustrated in FIG. 17, but showing the releasing state of the buckle

In use, as shown in FIG. 17 illustrating a locking state of the buckle 80, the latch 82 is displaced within the fastener 84 so that inner surfaces 92 of tabs 90 are prevented from moving laterally inside by outer surfaces 94 of a locking element 90. To unlock the buckle 80, the user applies a force to the knob 88 and displaces it along a wide region 98 of the recess 86 (FIG. 19) so that the knob urges against the locking element 90, which, due to its elasticity, yields the force and moves forward (FIG. 18). Hence, the space, initially occupied by the outer surfaces 94 of the locking element 90, is cleared allowing the user to push the tabs 90 inwards and disengage the components of the buckle, if desired.

Figure 19:
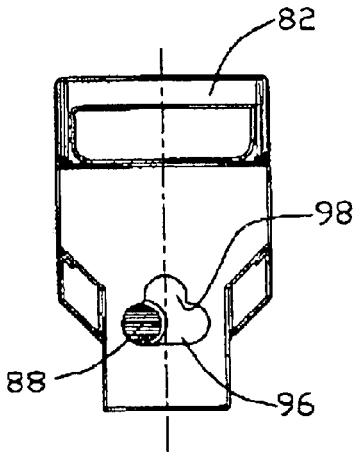
FIG. 19 is a front view of the buckle similar to that of FIG. 15. But illustrating a position in which the buckle is in its continuous releasing state.
Figure 20:
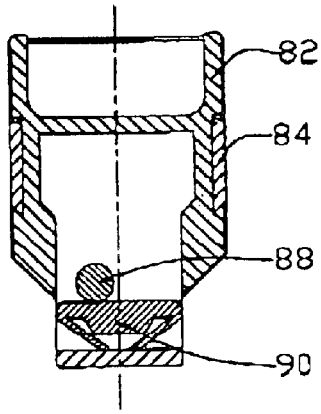
FIG. 20 is cross-sectional view of the buckle as shown in FIG. 19.

If it desired to preserve the releasing state of the buckle without, however, disengaging the fastener from the latch 82, the knob 88 is displaced to one of narrow side regions 96 flanking the wide region 98 of the recess 86. Dimensions of the side regions 98 and the knob 88 are so selected that unless the user forces the knob 88 towards the wide region 96, the edge defining the side regions lockably engages the knob 88, as seen in FIGS. 19–20.

It will be understood that various modifications may be made to the embodiments disclosed herein. Therefore, the above description should not be construed as limiting the scope of the invention, but merely as an exemplification of the preferred embodiments. Those skilled in the art will envision other modifications within the scope and spirit of the claims appended hereto.

What is claimed is:

1. A buckle comprising a fastener and a latch displaceable linearly relative to one another between engaging and disengaging positions and configured so that the latch and fastener are locked against displacement relative to one another simultaneously with reaching the engaging position, which corresponds to a locking state of the buckle, and a locking assembly mounted in the fastener and operative to unlock the latch from the fastener so that the latch is capable of deflecting in response to the external force, wherein the unlocked latch and fastener define a release state of the buckle, in which the latch and the fastener are enabled to slide linearly away from one another to the disengaging position, and the locking assembly includes a locking element and a cam cooperating with one another so that when the fastener and the latch are sliding linearly to the engaging position, the locking element being displaceable frontward to allow the latch and fastener to engage one another, the locking element being automatically displaceable backwards simultaneously with the engagement of the latch and the fastener to prevent further displacement thereof.

2. The buckle of claim 1, wherein the locking element is provided with a resilient element pressing against a stop front surface of the fastener with a biasing force sufficient to bias the locking element backwards so that the locking element is juxtaposed with and presses against the latch, which is prevented from displacement out of the engaging position in response to the external force in the locking state of the buckle.

3. The buckle of claim 2, wherein the locking element displaces toward the stop front surface in response to a force exerted by the cain during rotation thereof and exceeding the biasing force of the resilient element, the latch being deflectable inwards out of the engaging position upon applying the external force after the locking element has been displaced.

4. The buckle of claim 3, wherein the cam is key-actuated to move between a first position, which corresponds to the locking state of the buckle and wherein no force is exerted upon the locking element, and a second position, wherein while the locking element is forced to move linearly towards the stop front surface of the fastener, the latch is enabled to deflect inwards out of the engaging position upon applying the external force.

5. A buckle comprising:

a fastener and a latch displaceable relative to one another between engaging and disengaging positions, the buckle operating in a locking state, wherein relative displacement between the latch and the fastener is prevented in the engaging position, and a release state, wherein the latch and the fastener are displaceable from the engaging position to the disengaging position;

a resilient element mounted to the fastener and having a pair of leaf springs converging toward a stop front surface of the fastener, and opposite outer sides each extending backwards from a respective leaf spring and juxtaposed with a respective inner surface of the latch in the engaging position to prevent displacement of the latch and the fastener to the disengaging position; and a cam mounted to the fastener and operative to displace the resilient element so that the opposite outer sides thereof are spaced from the inner sides of the latch at a distance allowing the latch to deflect inwards in response to an external force applied thereto to the disengaging position.

6. The buckle of claim 1, wherein the cam is a rotatable element having a body provided with a periphery including at least two differently shaped and sized surfaces, the body having a key hole for receiving a key actuating the rotation of the cam.

7. A buckle comprising:

a fastener defining an interior;

a latch sized and shaped to linearly slide into the interior of the fastener to assume an engaging position, the latch and fastener being automatically locked against relative displacement in response to an external force applied to the latch simultaneously with reaching the engaging position, thereby defining a locking state of the buckle, wherein the fastener has a housing extending along a longitudinal axis and provided with a front stop surface, two spaced recesses bridged by the front stop surface and each having a respective support surface spaced axially rearwards from the front stop surface, the latch having a pair of flexible arms deflectable laterally inwards in response to an external force to allow the latch to slide through the housing toward the front stop surface, and the flexible arms being provided with front-end tabs and displaceable laterally outwards after the engaging surfaces move past and engage the support surfaces of the housing to define the engaging position of the latch.

8. A lockable buckle comprising:

a fastener defining an interior;

a latch sized and shaped to linearly slide into the interior of the fastener to assume an engaging position, the latch and fastener being automatically locked in a locking state of the buckle, wherein relative displacement of the latch and the fastener in response to an external force applied to the latch is prevented simultaneously with establishing the engaging position, and the fastener has a housing extending along a longitudinal axis and provided with a front stop surface, two spaced recesses bridged by the front stop surface and each having a respective support surface spaced axially rearwards from the front stop surface, the latch having a pair of flexible arms deflectable laterally inwards in response to an external force to allow the latch to slide through the housing toward the front stop surface, and the flexible arms being provided with front-end tabs and displaceable laterally outwards after the engaging surfaces move past and engage the support surface to define the engaging position of the latch.

9. A method of operating a buckle, comprising the steps of:

(a) linearly advancing a latch forward into a fastener;

(b) simultaneously with step (a) engaging a locking element, resiliently biased rearwards in the fastener, by the latch, thereby displacing the locking element forward so that opposite tabs of the latch are engaged in respective recesses provided in the fastener, (c) engaging the latch and fastener, thereby preventing further linear displacement thereof relative to one another; and (d) simultaneously with the engagement between the latch and fastener displacing the locking element rearwards so that the locking element is juxtaposed with the tabs of the latch to prevent inward displacement of the tabs, thereby establishing a locked state of the buckle.

10. The method of claim 9, further comprising the step of actuating a cam cooperating with the locking element and configured to displace the locking element forward so as to form a space in the fastener sufficient to allow the tabs to move inwards, thereby establishing a release state of the buckle, wherein the ledge is operative to disengage the fastener.

11. The method of claim 10, further comprising the step of actuating the cam by a key insertable into the housing.

* * * * *